US011737940B2

(12) United States Patent
Tsukayama et al.

(10) Patent No.: US 11,737,940 B2
(45) **Date of Patent: *Aug. 29, 2023**

(54) METHODS AND APPARATUSES FOR SUPPORTING PRACTITIONERS OF FOOT-BASED MASSAGE TECHNIQUES

(71) Applicant: SARGA BODYWORK LLC, Kailua, HI (US)

(72) Inventors: Daniel Tsukayama, Kailua, HI (US); Jivatma Massaguer Garcia, Kailua, HI (US)

(73) Assignee: SARGA BODYWORK, Kailua, HI (US)

( * ) Notice: Subject to any disclaimer, the term of this patent is extended or adjusted under 35 U.S.C. 154(b) by 354 days.

This patent is subject to a terminal disclaimer.

(21) Appl. No.: 17/215,820

(22) Filed: Mar. 29, 2021

(65) Prior Publication Data

US 2021/0212875 A1 Jul. 15, 2021

Related U.S. Application Data

(63) Continuation of application No. 15/342,438, filed on Nov. 3, 2016, now Pat. No. 10,959,897.

(51) Int. Cl.

| | |
|---|---|
| ***A61H 37/00*** | (2006.01) |
| ***A61G 13/00*** | (2006.01) |
| ***A61G 13/10*** | (2006.01) |

(52) U.S. Cl.

CPC ..... *A61G 13/009* (2013.01); *A61G 13/101* (2013.01); *A61H 37/00* (2013.01)

(58) Field of Classification Search

CPC ..... A61G 13/009; A61G 13/12; A61H 1/008; A61H 2201/0138

See application file for complete search history.

(56) References Cited

U.S. PATENT DOCUMENTS

| | | | | |
|---|---|---|---|---|
| 4,371,162 | A | 2/1983 | Hartzell | |
| 4,787,630 | A | 11/1988 | Watson | |
| 4,943,041 | A | 7/1990 | Romein | |
| 5,009,170 | A | 4/1991 | Spehar | |
| 6,575,876 | B1 * | 6/2003 | Phelps-McMillon | A63B 23/047 482/54 |

(Continued)

OTHER PUBLICATIONS

Jiva Bodywork Modalities, http://www.jivabodywork.com/modalities.html, Sep. 2016.

(Continued)

*Primary Examiner* — Tu A Vo
*Assistant Examiner* — Christopher E Miller
(74) *Attorney, Agent, or Firm* — Young Basile Hanlon & MacFarlane, P.C.

(57) ABSTRACT

A method of administering a massage that comprises providing a foldable massage table having a first half and a second half and assembling the foldable massage table. The first half of the foldable massage table is locked to the second half of the foldable massage table in an assembled position. At least two portions of a flexible member are secured to opposite sides of the foldable massage table. The massage practitioner stands on the foldable massage table and utilizes the flexible member to assist with delivery of force to a patient lying on the foldable massage table. A foot of the massage practitioner is used to massage the patient.

20 Claims, 5 Drawing Sheets

(56) References Cited

U.S. PATENT DOCUMENTS

| | | | | |
|---|---|---|---|---|
| 7,962,982 | B1 | 6/2011 | Fellrath | |
| 8,088,050 | B2 | 1/2012 | Aucamp | |
| 8,381,734 | B2 | 2/2013 | Hedges et al. | |
| 8,499,387 | B2 | 8/2013 | Gharieni | |
| 2004/0045483 | A1 | 3/2004 | Hardee | |
| 2006/0112490 | A1 | 6/2006 | Chausse | |
| 2014/0052034 | A1* | 2/2014 | Marxer | A61H 37/00 601/134 |
| 2016/0008650 | A1 | 1/2016 | Jue et al. | |
| 2017/0172832 | A1 | 6/2017 | Rosario, Jr. et al. | |
| 2018/0290002 | A1 | 10/2018 | Colangelo | |

OTHER PUBLICATIONS

International Search Report and Written Opinion in PCT/US2019/063944, dated Mar. 4, 2020, 13 pages.

* cited by examiner

METHODS AND APPARATUSES FOR SUPPORTING PRACTITIONERS OF FOOT-BASED MASSAGE TECHNIQUES

CROSS-REFERENCE TO RELATED APPLICATION

This application is a continuation of U.S. Pat. No. 10,989,897, issued on Mar. 30, 2021, the content of which is incorporated by reference in its entirety.

TECHNICAL FIELD

This disclosure relates to generally to massage techniques, and more particularly to methods and apparatuses for supporting practitioners of foot-based massage techniques.

BACKGROUND

Massage practitioners have not been exempt from the increasing influence of alternative and Eastern medicine in the west. Shiatsu and Thai-Massage are examples of modalities that allow massage practitioners to utilize a much wider range of body mechanics than the Swedish-styles prevalent in Europe and North America. With this wider range, massage practitioners reduce fatigue and minimize the risk of repetitive-use injuries in the upper body.

One such modality derived from Eastern influences is foot-based massage where massage practitioners use gravity and their body weight to massage patients. The nature of foot-based massage often requires structural support for balance. Because of this, massage practitioners frequently use either an overhead rope fastened to an end of a room for support or a set of overhead bars that are either mounted to the ceiling or part of a bulky apparatus to administer a foot-based massage.

SUMMARY

Methods and apparatuses for supporting practitioners of foot-based massage techniques are disclosed herein. According to a first implementation, a foldable massage table having a first half and a second half is provided and assembled. The first half of the foldable massage table is locked to the second half of the foldable massage table in an assembled position. At least two portions of a flexible member are secured to opposite sides of the foldable massage table. The massage practitioner stands on the foldable massage table and utilizes the flexible member to assist with delivery of force to a patient lying on the foldable massage table. A foot of the massage practitioner is used to massage the patient.

According to a second implementation, a first half of a foldable massage table is secured to a second half of the foldable massage table while the foldable massage table is in an open position. This is done to prevent movement of the first half of the foldable massage table in relation to the second half of the foldable massage table. A flexible member is attached to the foldable massage table such that the flexible member extends upward from the foldable massage table, over an upper body of a massage practitioner, in use. The massage practitioner uses the flexible member to assist with balance and delivery of force to a patient lying on the foldable massage table and massages the patient lying on the foldable massage table using his or her foot.

According to a third implementation, a first portion of a flexible member is secured under a first lateral side of a patient supporting surface approximately halfway between a first longitudinal end of the patient supporting surface and a second longitudinal end of the patient supporting surface. A second portion of the flexible member is secured under a second lateral side of the patient supporting surface approximately halfway between the first longitudinal end of the patient supporting surface and the second longitudinal end of the patient supporting surface. When in use, the flexible member extends upward from the first and second lateral sides toward a massage practitioner. The massage practitioner utilizes the flexible member to assist with administering a massage to a patient lying on the patient supporting surface using his or her foot.

BRIEF DESCRIPTION OF THE DRAWINGS

The disclosed methods and apparatuses are best understood from the following detailed description when read in conjunction with the accompanying drawings. It is emphasized that, according to common practice, the various features of the drawings are not to scale. On the contrary, the dimensions of the various features are arbitrarily expanded or reduced for clarity.

DETAILED DESCRIPTION

Figure 1:
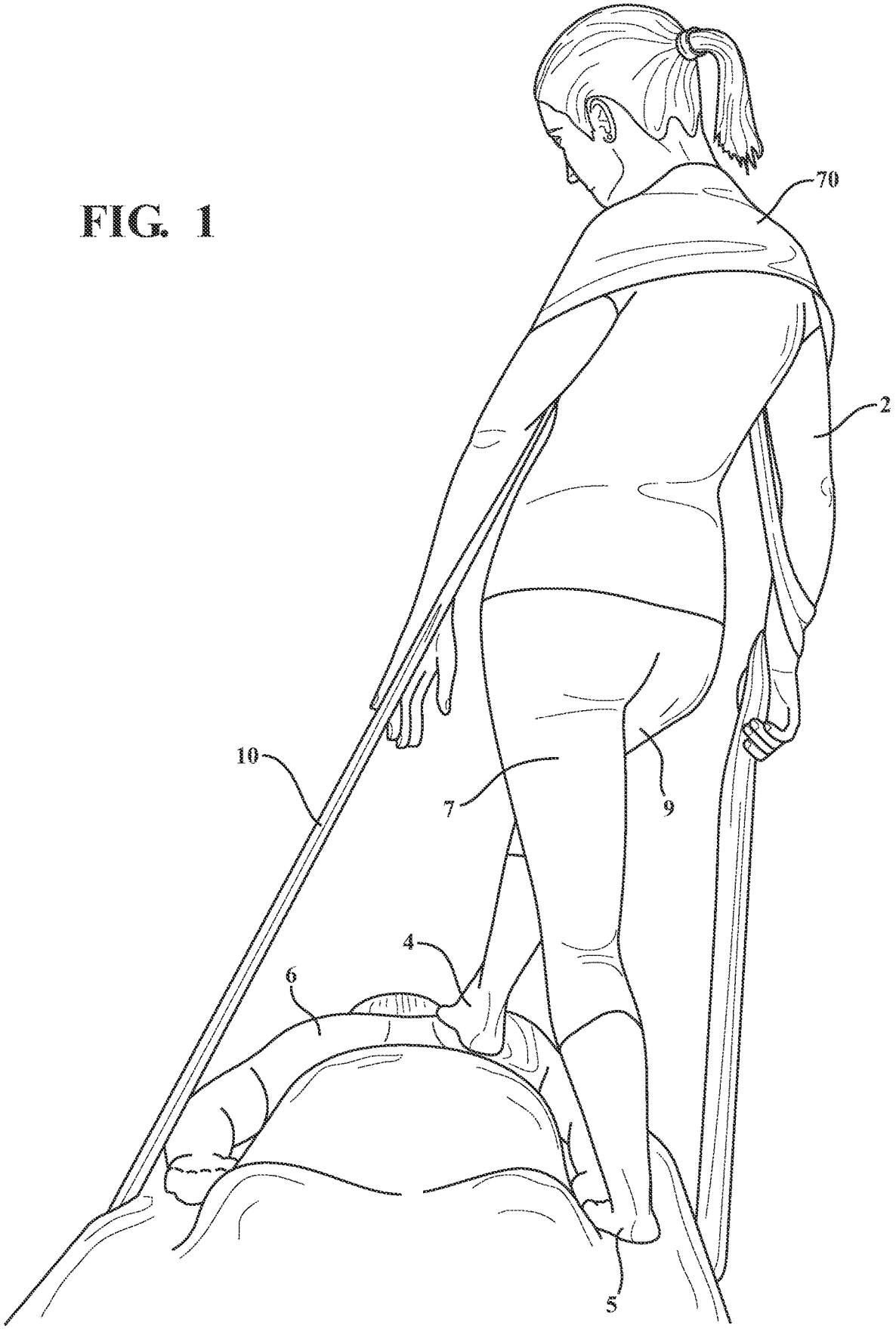
FIG. 1 is a perspective view of a massage practitioner giving a foot-based massage to a patient on a patient supporting structure.

FIG. 1 shows a massage practitioner 2 using her feet 4, 5 to administer a foot-based massage to a patient 6 lying on a patient supporting surface 8. During the massage, the patient 6 is substantially parallel to the patient supporting surface 8 and lays in the direction in which the patient supporting surface 8 extends, and the massage practitioner 2 stands on the patient supporting surface 8. In the illustrated, non-limiting example, the patient 6 is in a prone position while the massage is administered by the massage practitioner 2. The massage can also be administered by the massage practitioner 2 while the patient 6 is in a supine position.

In the illustrated, non-limiting example, the massage practitioner 2 supports the bulk of her weigh on her left leg 7, which is resting on the patient supporting surface 8 adjacent to the patient 6. A substantially right angle can be formed between the patient supporting surface 8 and the supporting leg, in this example the left leg 7. The massage is administered to the patient 6 using the foot of her non-supporting leg, in this example the right foot 4 and right leg 9. It is possible for the massage practitioner 2 to simultaneously use both of her feet 4, 5 to deliver the massage or alternatively use her left foot 5 to administer the massage while resting her right leg 9 on the patient supporting surface 8 adjacent to the patient 6.

To assist the massage practitioner 2 in maintaining her balance while administering the massage, a flexible member 10 affixed to the patient supporting surface 8. In the illustrated example, ends of the flexible member 10 are affixed or fixedly mounted to the patient supporting surface 8 with a mid-section of the flexible member 10 resting on shoulders 70 of the massage practitioner 2, which results in the flexible member 10 having a generally triangular configuration extending substantially perpendicular from the patient supporting surface 8 while the massage is being administered. The ends of the flexible member 10 are spaced apart from one another in a direction that is substantially perpendicular to the direction in which the patient 6 is laying. This allows the massage practitioner 2 to use tensional force, in addition to gravitational force, to administer the massage to the patient 6.

The patient supporting surface 8 can be any substantially planar surface capable of providing adequate support to the patient 6 and the massage practitioner 2 and remaining substantially stationary while the massage is administered. Possible patient support surfaces 8 include, but are not limited to, a floor, a mat resting on the floor, a table, a massage table, a stationary massage table, or a portable massage table. In the illustrated, non-limiting example, the patient supporting surface 8 is a portable massage table 12.

Figure 2:
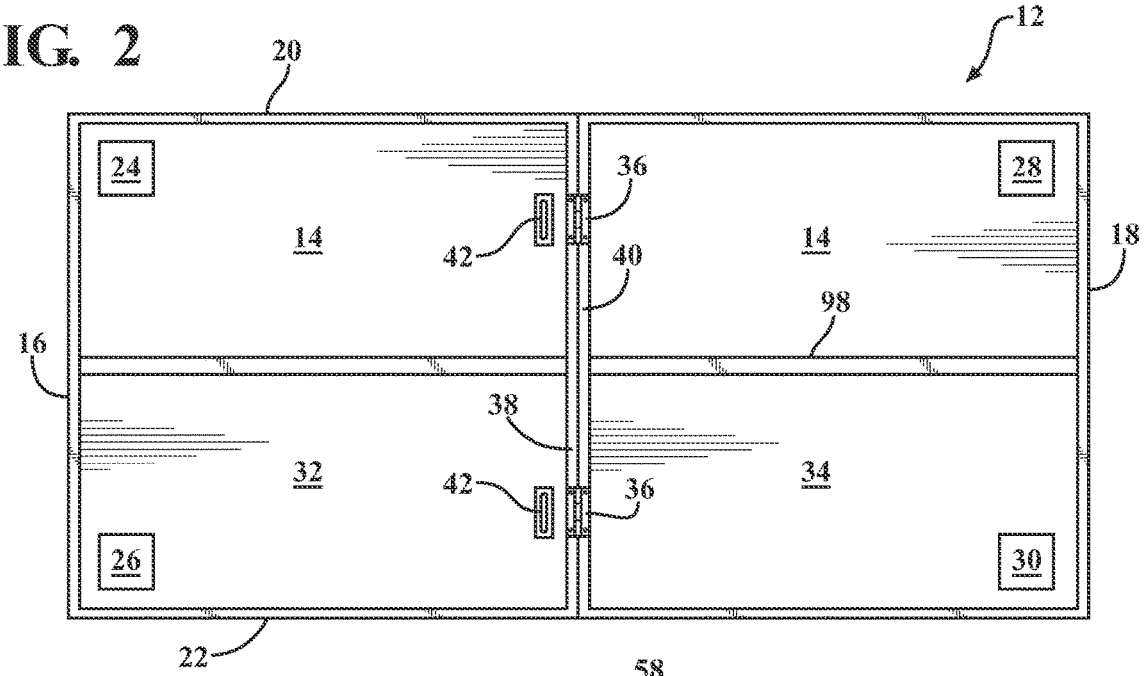
FIG. 2 is a schematic drawing of an underside of a portable massage table.

An underside 14 of the portable massage table 12 is illustrated in FIG. 2. The portable massage table 12 extends longitudinally from a first end 16 to a second end 18 and laterally from a third end 20 to a fourth end 22. A first leg 24 extends from the underside 14 of the portable massage table 12 near a corner where the first end 16 and the third end 20 meet, and a second leg 26 extends from the underside 14 of the portable massage table 12 near a corner where the first end 16 and the fourth end 22 meet. A third leg 28 extends from the underside 14 of the portable massage table 12 near a corner where the second end 18 and the third end 20 meet, and a fourth leg 30 extends from the underside 14 of the portable massage table 12 near a corner where the second end 18 and the fourth end 22 meet. The first leg 24, the second leg 26, the third leg 28, and the fourth leg 30 can have any cross-sectional configuration, such as rectangular or circular, and any length, such as a few inches to a few feet.

To provide portability, the first leg 24, the second leg 26, the third leg 28, and the fourth leg 30 can be collapsible or foldable in relation to the portable massage table 12. The portable massage table 12 can further be comprised of a first portion 32 and a second portion 34 that are substantially similar and are hingedly connected to one another. The first portion 32 includes the first end 16, the first leg 24, and the second leg 26 of the portable massage table 12, and the second portion 34 includes the second end 18, the third leg 28, and the fourth leg 30 of the portable massage table 12.

In the illustrated, non-limiting example, the first portion 32 and the second portion 34 are hingedly connected to one another through the use of two hinges 36 attached to a first lateral support 38 and a second lateral support 40. The first lateral support 38 and the second lateral support 40 are fixedly connected to the underside 14 of the portable massage table 12 and can have any cross-sectional configuration, such as rectangular or circular. The first lateral support 38 is closer to the first end 16 of the portable massage table 12 than the second end 18 of the second end 18 of the portable massage table 12, and the second lateral support 40 is closer to the second end 18 of the portable massage table 12 than the first end 16 of the portable massage table 12. The hinges 36 are spaced between the third end 20 and the fourth end 22 of the portable massage table 12 and allow the portable massage table 12 to move between a collapsed position, where the first portion 32 and the second portion 34 of the portable massage table 12 face one another, and an open position, where the first portion 32 and the second portion 34 of the portable massage table 12 are substantially planar with one another. The portable massage table 12 is held in the open position by gravity and will move into the closed position when an upward force is applied to the underside 14 of the portable massage table 12.

Clasps 42 can be used to affix the flexible member 10 to the patient supporting surface 8. In the illustrated, non-limiting example, the flexible member 10 is affixed to two clasps 42 mounted to the underside 14 of the portable massage table 12 adjacent to the hinges 36 on the first portion 32 of the portable massage table 12. Mounting the clasps 42 near the hinges 36 allows the flexible member 10 to be affixed to the portable massage table 12 approximately halfway between the first end 16 and the second end 18 of the portable massage table 12. The clasps 42 are spaced laterally between the third end 20 and the fourth end 22 of the portable massage table 12 such that one clasp 42 is approximately one quarter of the distance between the third end 20 and the fourth end 22 of the portable massage table 12 and the other clasp 42 is approximately three quarters of the distance between the third end 20 and the fourth end 22 of the portable massage table 12. It is anticipated that the clasps 42 could be mounted elsewhere, such as a topside of the portable massage table 12, adjacent to the first end 16 or the second end 18 of the portable massage table 12, or spaced in a different manner laterally between the third end 20 and the fourth end 22 of the portable massage table 12.

Figure 3:
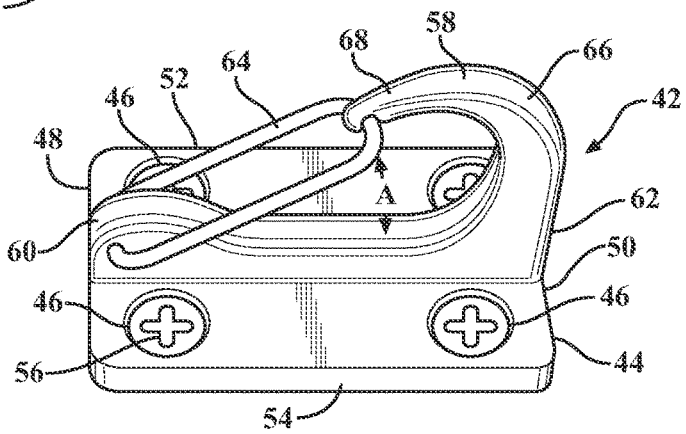
FIG. 3 is a perspective view of an exemplary clasp that can be used to affix a flexible member to the underside of the portable massage table.

An example of the clasp 42 is shown in FIG. 3. In the illustrated, non-limiting example, the clasp 42 has a substantially rectangular base 44 with four apertures 46 extending through the base 44. The base 44 extends longitudinally from a first end 48 to a second end 50 and laterally from a third end 52 to a fourth end 54. The apertures 46 are disposed near corners of the base 44 and receive conventional fasteners 56, which allow the clasp 42 to be secured to the portable massage table 12. A connecting member 58 having a generally U-shaped configuration extends substantially perpendicular from the base 44 of the clasp 42. A first end 60 and a second end 62 of the connecting member 58 are connected to the base 44. Examples of possible connections include the first end 60 and the second end 62 being integrally formed with or welded to the base 44. The first end 60 of the connecting member 58 is adjacent to the first end 48 of the base 44 approximately halfway between the third end 52 and the fourth end 54 of the base 44. The second end 62 of the connecting member 58 is adjacent to the second end 50 of the base 44 approximately halfway between the third end 52 and the fourth end 54 of the base 44. In other implementations, the clasps 42 could be rings, collars, hooks, eyes, or other similar mechanisms that allow the flexible member 10 to be affixed to the portable massage table 12.

To assist with attaching the flexible member 10, the connecting member 58 of the clasp 42 can be comprised of a first portion 64 and a second portion 66. The first portion 64 of the connecting member 58 can be pivotally connected to the base 44 of the clasp 42 at the first end 60 of the connecting member 58. The second portion 66 of the connecting member 58 is fixedly connected to the base 44 of the clasp 42. A portion of the second portion 66 of the connecting member 58 overlaps the first portion 64 of the connecting member 58 such that the second portion 66 of the connecting member 58 stops pivotable movement along arrow A. A biasing element (not shown) can be provided with the first end 60 of the connecting member 58 that biases the first portion 64 of the connecting member 58 toward the portion of the second portion 66 of the connecting member 58 that overlaps the first portion 64 of the connecting member 58. This allows the first portion 64 of the connecting member 58 to rest against the second portion 66 of the connecting member 58 after a portion of the flexible member 10 clears the first portion 64 of the connecting member 58 and is in an aperture 68 defined by the base 44 and the connecting member 58 of the clasp 42. Alternatively, the first portion 64 and the second portion 66 of the connecting member 58 could be integrally formed with or fixedly connected to one another.

The flexible member 10 is affixed to the patient support surface 8 and is used by the massage practitioner 2 to assist with balance while delivering a foot-based massage. The flexible member 10 could be a strip of fabric, a rope, a strap, or any other elongated, flexible structure affixed to the patient supporting surface 8. In the illustrated, non-limiting example, the flexible member 10 is a strip of two-way stretch polyester lycra or tricot nylon that is approximately 38 inches wide and approximately twice the height of the massage practitioner 2 long. This configuration allows ends of the flexible member 10 to be tied to the clasps 42 mounted on the underside 14 of the portable massage table 12 and the flexible member 10 to comfortably and snuggly rest on shoulders 70 of the massage practitioner 2 while the massage practitioner 2 is fully upright on the portable massage table 12 as illustrated in FIG. 1. It is anticipated, however, that another material or another set of dimensions could be used for the flexible member 10. Instead of being tied to the clasps 42, each end of the flexible member 10 could alternatively be provided with a loop (not shown) that allows the flexible member 10 be attached to the portable massage table 12. The flexible member 10 could also be longer or shorter.

Figure 4:
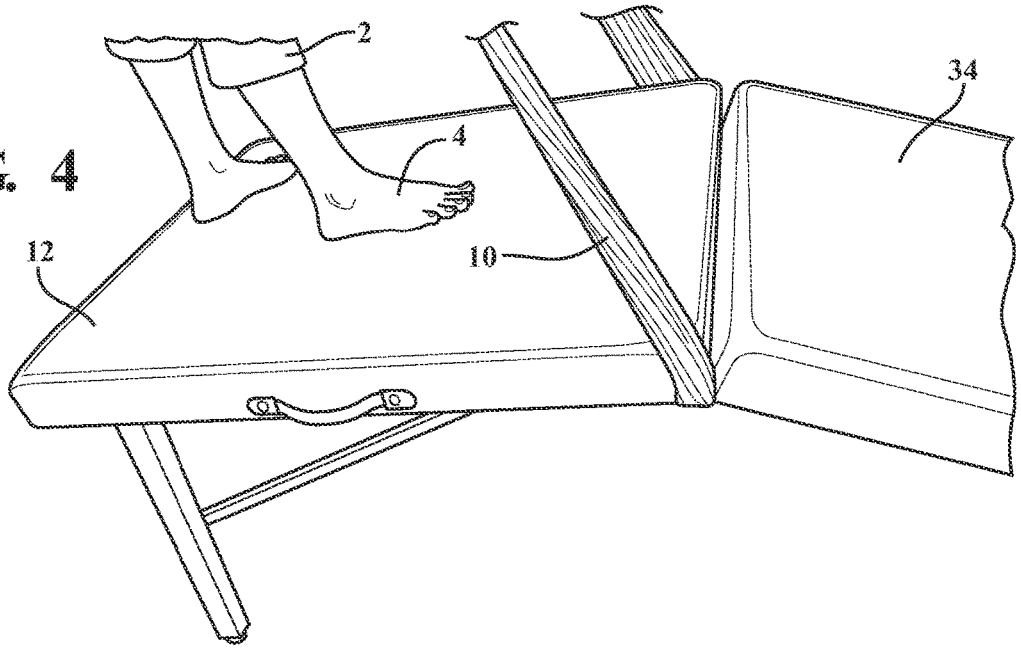
FIG. 4 is a perspective view of the massage practitioner attempting to utilize the flexible member affixed to the underside of the portable massage table.

In FIG. 4, the massage practitioner 2 is shown standing on the portable massage table 12 without the patient 6. As the massage practitioner 2 applies an upward force to the flexible member 10, the first portion 32 and second portion 34 of the portable massage table 12 are starting to move into the collapsed position because the hinges 36 of the portable massage table 12 lack a mechanism to lock the first portion 32 and the second portion 34 of the portable massage table 12 into the open position. To prevent this from occurring, fasteners can be used to fix the first portion 32 and the second portion 34 of the portable massage table 12 into the open position. The fastening can be temporary or permanent. For example, one or more clamps (not shown) could be fastened to the first lateral support 38 and the second lateral support 40 to temporarily restrain the first portion 32 and the second portion 34 of the portable massage table 12 in the open position. Alternatively, screws or bolts (not shown) could be inserted through the first lateral support 38 and the second lateral support 40 to semi-permanently restrain the first portion 32 and the second portion 34 of the portable massage table 12 in the open position.

FIGS. 5-9 show an apparatus 72 that can be used to adapt the portable massage table 12 for use with the flexible member 10. The apparatus 72 includes an elongated body 74 and at least one clasp 42 attached to the elongated body 74. In the illustrated, non-limiting example, the elongated body 74 is fabricated from a metallic material and extends longitudinally between a first end 76 and a second end 78. The elongated body 74 has a substantially U-shaped cross-sectional configuration defined by a first panel 80, a second panel 82, and a third panel 84. The third panel 84 is disposed between the first panel 80 and a second panel 82. The first panel 80, the second panel 82, and the third panel 84 can be formed by bending the elongated body 74, resulting in radiused bends between the first panel 80 and the third panel 84, and the second panel 82 and the third panel 84. Alternatively, the first panel 80, the second panel 82, and the third panel 84 can be welded together.

Figure 5:
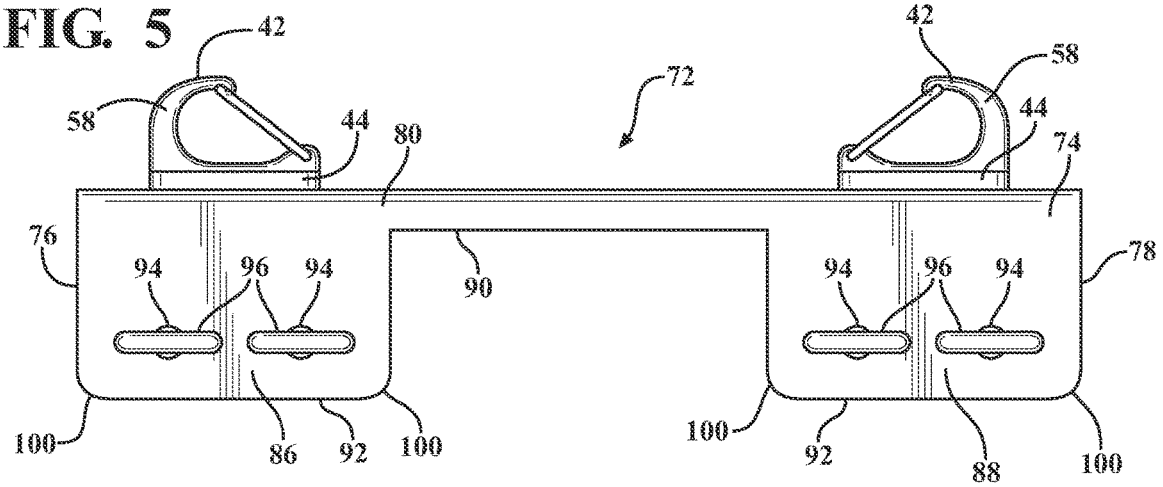
FIG. 5 is a front view of an apparatus for adapting the portable massage table.

The first panel 80 is illustrated in FIG. 5. The first panel 80 is comprised of a first portion 86 adjacent to the first end 76, a second portion 88 adjacent to the second end 78, and a recess 90 formed along a free end 92 of the first panel 80 between the first portion 86 and the second portion 88. As illustrated, the recess 90 has a substantially rectangular configuration and is generally centered between the first end 76 and the second end 78 of the first panel 80. The height and width of the recess 90 can vary between implementations of the apparatus 72 to provide clearance for a longitudinal support 98 of the portable massage table 12 (shown in FIG. 2), which can be present in some implementations of the portable massage table 12.

The first portion 86 and the second portion 88 of the first panel 80 are substantially similar with each having a substantially rectangular configuration. Corners 100 of the first portion 86 and the second portion 88 can have a substantially arcuate configuration to help prevent the flexible member 10 from becoming caught or snagged by the corners 100. In the illustrated, non-limiting example, the first portion 86 and the second portion 88 of the first panel 80 each have two aligned apertures 94 extending there through that are capable of receiving conventional fasteners 96, which are used to secure the apparatus 72 to the underside 14 of the portable massage table 12. The conventional fasteners 96 can be provided with a handle 97 to assist with temporarily securing the apparatus 73 to the portable massage table 12. In other implementations, the conventional fasteners 96 could be clamps, levers, or other similar mechanisms that allow the apparatus 73 to be secured to the underside 14 of the portable massage table 12.

Figure 6:
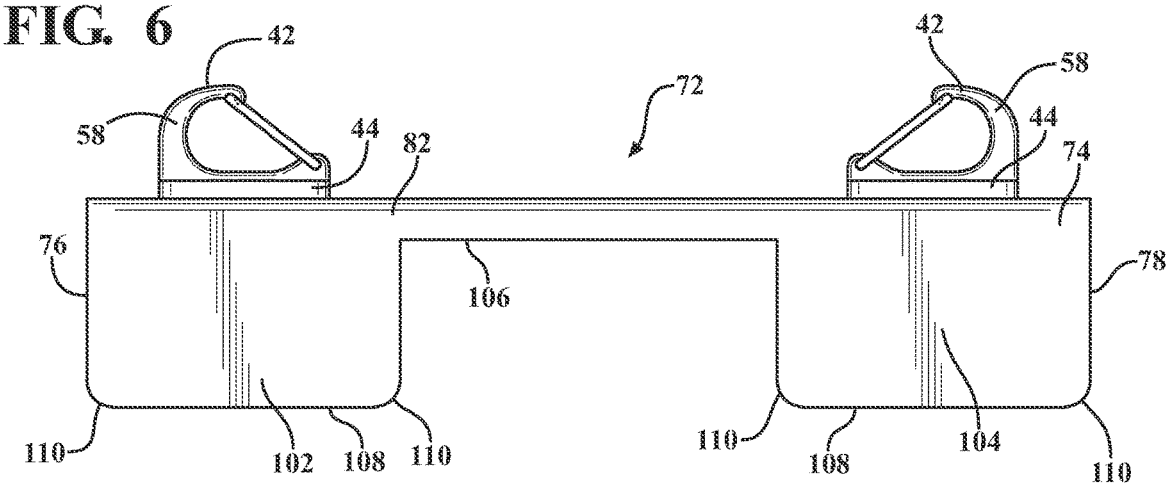
FIG. 6 is a rear view of the apparatus for adapting the portable massage table.

The second panel 82 is illustrated in FIG. 6. Similar to the first panel 80, the second panel 82 is comprised of a first portion 102 adjacent to the first end 76, a second portion 104 adjacent to the second end 78, and a recess 106 formed along a free end 108 of the second panel 82 between the first portion 102 and the second portion 104. As illustrated, the recess 108 has a substantially rectangular configuration and is generally centered between the first end 76 and the second end 78 of the second panel 82. The height and width of the recess 106 can vary between implementations of the apparatus 72 to provide clearance for the longitudinal support 98 of the portable massage table 12. Corners 110 of the first portion 102 and the second portion 104 can have a substantially arcuate configuration to help prevent the flexible member 10 from becoming caught or snagged by the corners 110.

Figure 7:
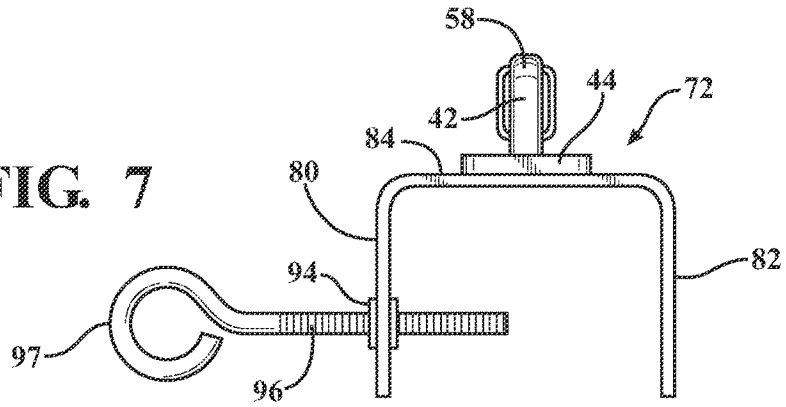
FIG. 7 is a right side view of the apparatus for adapting the portable massage table.
Figure 8:
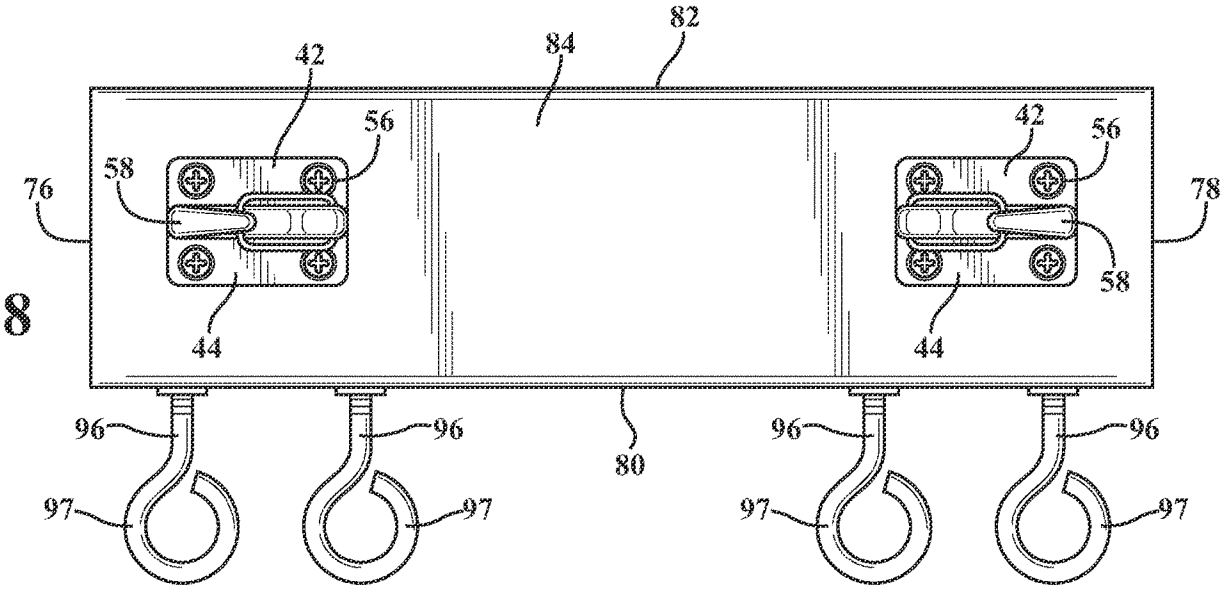
FIG. 8 is a top view of the apparatus for adapting the portable massage table.
Figure 9:
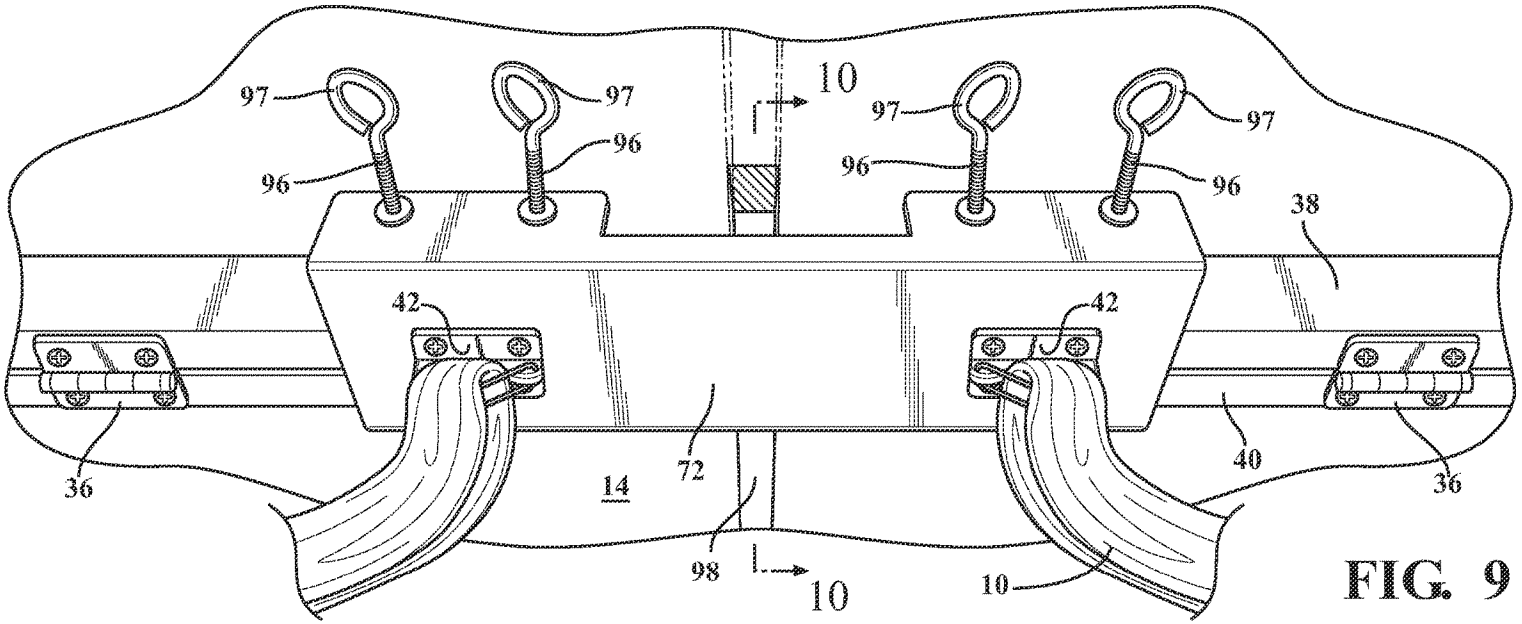
FIG. 9 is a perspective view of the apparatus affixed to the underside of the portable massage table and the flexible member attached to the apparatus.

To secure the flexible member 10 to the apparatus 72, the apparatus 72 is provided with at least one clasp 42. As shown in FIGS. 7-9, there are two clasps 42 affixed to the third panel 84. The clasps 42 can be longitudinally spaced between the first end 76 and the second end 78 of the elongated body 74 with each clasp 42 being generally centered on the third panel 84 between the first panel 80 and the second panel 82. One of the clasps 42 is disposed on the third panel 84 between the first portion 86 of the first panel 80 and the first portion 102 of the second panel 82, and the other clasp 42 is disposed on the third panel 84 between the second portion 88 of the first panel 80 and the second portion 104 of the second panel 82. A longest dimension of each clasp 42 can extend longitudinally, which results in the substantially U-shaped configuration of the connecting member 58 and the substantially U-shaped configuration of the elongated body 74 being substantially perpendicular to one another. The clasps 42 can be integrally formed with the elongated body 74 or conventional fasteners 56 can secure the base 44 of each clasp 42 to the third panel 84 of the elongated body 74.

Figure 10:
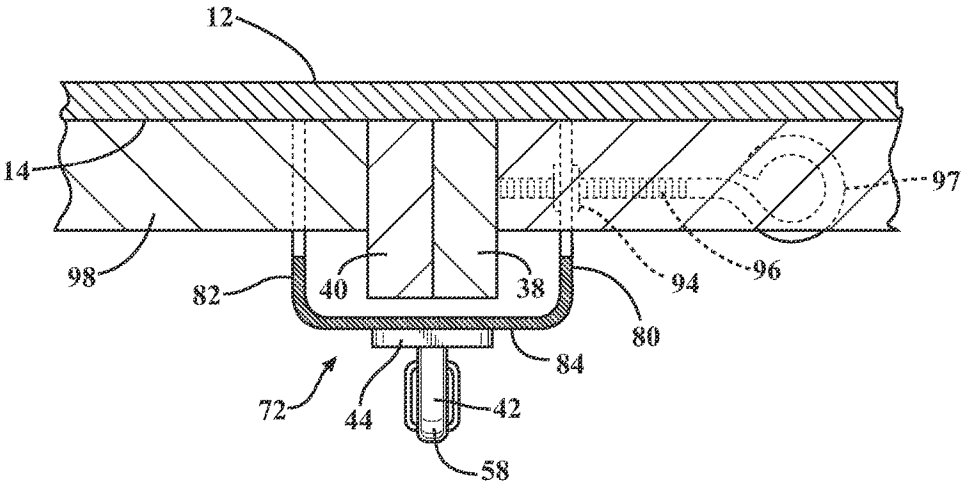
FIG. 10 is a cross-sectional view of the apparatus affixed to the underside of the portable massage table.

To prevent the portable massage table 12 from moving into the collapsed position during a foot-based massage, the apparatus 72 can be secured to the first lateral support 38 and the second lateral support 40 of the portable message table 12 as shown in FIG. 10. To do this, the apparatus 72 is positioned so that the first lateral support 38 and the second lateral support 40 extend along the channel defined by the substantially U-shaped configuration of the apparatus 72. In the illustrated, non-limiting example, the first lateral support 38 and the second lateral support 40 of the portable massage table 12 are positioned between the first panel 80 and the second panel 82 of the apparatus 72 with the elongated body 74 of the apparatus 72 substantially centered between the third end 20 and the fourth end 22 of the portable massage table 12. The free end 92 of the first panel 80 and the free end 108 of the second panel 82 can be substantially flush with the underside 14 of the portable massage table 12. If the portable massage table 12 provides the longitudinal support 98, the longitudinal support 98 can extend through the recess 90 on the first panel 80 and the recess 106 on the second panel 82 of the apparatus 72. Once in position, the apparatus 72 is secured to the underside 14 of the portable massage table 12. In the illustrated, non-limiting example, the conventional fasteners 96 are inserted through the apertures 94 on the first panel 80 of the apparatus 72 and into at least one of either the first lateral support 38 or the second lateral support 40 of the portable massage table 12.

The flexible member 10 can be attached to the clasps 42 in any known manner. For example, if the connecting member 58 of the clasp 42 is fixedly mounted to the base 44 of the clasp 42, an end of the flexible member 10 can be threaded through the aperture 68 of the clasp 42 and knotted on the other side of the aperture 68. In another example, the first portion 64 of the connecting member 58 of the clasp 42 is pivotally mounted to the base 44 of the clasp 42 and the end of the flexible member 10 has a pre-existing loop or knot, the loop or knot can be inserted into the aperture 68 of the clasp 42 by pressing the first portion 64 of the connecting member 58 away from the second portion 66 of the connecting member 58 of the clasp 42.

Once the first portion 32 has been secured in relation to the second portion 34 of the portable massage table 12 and the flexible member 10 has been attached to the portable massage table 12, the massage practitioner 2 can administer a foot-based massage to the patient 6 lying on the portable massage table 12 while using the flexible member 10 to assist with balance. If the flexible member 10 is stretched to rest on the shoulders 70 of the massage practitioner 2, tensional force will be directed toward the patient 6.

After the massage has been given, the apparatus 72 can be removed from the portable massage table 12 by loosening the conventional fasteners 96. This allows the portable massage table 12 to retain its portability. The flexible member 10 can remain attached to the apparatus 72 or can be removed from the apparatus 72 at the option of the massage practitioner 2. The flexible member 10 can be removed from the clasps 42 of the apparatus 72 by reversing the manner in which it was attached.

While the disclosed methods and apparatus have been described in connection with certain embodiments or implementations, it is to be understood that the invention is not to be limited to the disclosed embodiments and implementations but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A method comprising:

providing a foldable massage table having a first half and a second half;

assembling the foldable massage table;

locking the first half of the foldable massage table to the second half of the foldable massage table in an assembled position;

securing at least two portions of a flexible member to opposite sides of an underside of the foldable massage table;

standing, by a massage practitioner, on the foldable massage table; and utilizing, by the upper body of the massage practitioner, a downward force from the flexible member to assist with delivery of force to a patient lying on the foldable massage table; and using a foot of the massage practitioner to massage the patient.

2. The method of claim 1, wherein the opposite sides of the foldable massage table are lateral sides.

3. The method of claim 2, wherein the foldable massage table is divided in half longitudinally to define the first half and the second half so that the first half and the second half meet halfway between longitudinal sides of the foldable massage table.

4. The method of claim 3, wherein locking the first half of the foldable massage table to the second half of the foldable massage table comprises:

attaching a fastening apparatus to an underside of the foldable massage table while the massage table is in an open position to prevent movement of the first half of the foldable massage table in relation to the second half of the foldable massage table.

5. The method of claim 4, wherein the fastening apparatus is attached to a joint formed between the first half of the foldable massage table and the second half of the foldable massage table.

6. The method of claim 5, wherein the at least two portions of the flexible member are ends of the flexible member.

7. The method of claim 6, wherein the ends of the flexible member are attached to the fastening apparatus.

8. The method of claim 2, wherein the flexible member extends upward from the lateral sides of the foldable massage table.

9. The method of claim 8, wherein the flexible member is secured to an underside of the foldable massage table.

10. A method comprising:

securing a first half of a foldable massage table to a second half of the foldable massage table while the foldable massage table is in an open position to prevent movement of the first half of the foldable massage table in relation to the second half of the foldable massage table;

attaching a flexible member to the foldable massage table such that the flexible member extends upward from below the foldable massage table, over an upper body of a massage practitioner, in use;

utilizing, by the massage practitioner, the flexible member to assist with balance and delivery of force to a patient lying on the foldable massage table; and massaging, by the massage practitioner, the patient lying on the foldable massage table using a foot of the massage practitioner.

11. The method of claim 10, wherein the flexible member is attached to an underside of the foldable massage table.

12. The method of claim 10, wherein ends of the flexible member are attached to an underside of the foldable massage table.

13. The method of claim 10, wherein the flexible member and the foldable massage table are used to administer the massage independent of an overhead, balance-providing structure.

14. A method comprising:

securing a first portion of a flexible member under a first lateral side of a patient supporting surface approximately halfway between a first longitudinal end of the patient supporting surface and a second longitudinal end of the patient supporting surface;

securing a second portion of the flexible member under a second lateral side of the patient supporting surface approximately halfway between the first longitudinal end of the patient supporting surface and the second longitudinal end of the patient supporting surface, wherein, when in use, the flexible member extends upward from the first and second lateral sides toward a massage practitioner; and utilizing, by the massage practitioner, the flexible member to assist with administering a massage to a patient lying on the patient supporting surface using a foot of the massage practitioner.

15. The method of claim 14, wherein the first portion is a first end of the flexible member, wherein the second portion is a second end of the flexible, and wherein the flexible member is continuous and flexible between the first end and the second end.

16. The method of claim 14, further comprising:

exclusively utilizing, by the massage practitioner, the flexible member for balance while administering the massage to the patient.

17. The method of claim 14, wherein hands of the massage practitioner exclusively use the flexible member to assist with balance while administering the massage to the patient.

18. The method of claim 14, wherein the flexible member and the patient supporting structure are used to administer the massage independent of an overhead, balance-providing structure.

19. The method of claim 14, wherein, when in use, a middle portion of the flexible member is adjacent to an upper body of the massage practitioner.

20. The method of claim 14, wherein, when in use, the flexible member stretches to rest on shoulders or a back of a neck of the massage practitioner.

* * * * *